US012221981B2

(12) United States Patent
Alaoui Benzakroum et al.

(10) Patent No.: US 12,221,981 B2
(45) Date of Patent: Feb. 11, 2025

(54) SUPPORT FRAME HOLDING ARM

(71) Applicant: Valeo Systemes Thermiques, Le Mesnil Saint-Denis (FR)

(72) Inventors: Mohamed Alaoui Benzakroum, Le Mesnil Saint Denis (FR); Bruno Demory, Le Mesnil Saint Denis (FR); Manuel Henner, Le Mesnil Saint Denis (FR); Maxime Laurent, Le Mesnil Saint Denis (FR)

(73) Assignee: VALEO SYSTEMES THERMIQUES, Le Mesnil-Saint-Denis (FR)

( * ) Notice: Subject to any disclaimer, the term of this patent is extended or adjusted under 35 U.S.C. 154(b) by 37 days.

(21) Appl. No.: 17/911,046

(22) PCT Filed: Feb. 25, 2021

(86) PCT No.: PCT/FR2021/050328
§ 371 (c)(1),
(2) Date: Sep. 12, 2022

(87) PCT Pub. No.: WO2021/181024
PCT Pub. Date: Sep. 16, 2021

(65) Prior Publication Data

US 2023/0104481 A1 Apr. 6, 2023

(30) Foreign Application Priority Data

Mar. 13, 2020 (FR) ..... 2002499

(51) Int. Cl.
*F04D 29/54* (2006.01)
*F01P 5/06* (2006.01)
(Continued)

(52) U.S. Cl.
CPC ..... *F04D 29/544* (2013.01); *F01P 5/06* (2013.01); *F04D 19/002* (2013.01); *F04D 25/06* (2013.01); *F04D 29/522* (2013.01)

(58) Field of Classification Search
CPC ..... F01P 11/10; F04D 19/002; F04D 25/08; F04D 25/12; F04D 29/522; F04D 29/544
See application file for complete search history.

(56) References Cited

U.S. PATENT DOCUMENTS 3,883,264 A * 5/1975 Rao ..... F04D 29/544 415/209.1
4,548,548 A * 10/1985 Gray, III ..... F04D 29/544 416/189
(Continued)

FOREIGN PATENT DOCUMENTS

EP 2821653 A1 1/2015
EP 2821653 B1 * 9/2019 ..... F04D 29/544
(Continued)

OTHER PUBLICATIONS

International Search Report and Written Opinion in corresponding International Application No. PCT/FR2021/050328, dated May 28, 2021 (11 pages).

*Primary Examiner* — Kenneth J Hansen
*Assistant Examiner* — Joseph S. Herrmann
(74) *Attorney, Agent, or Firm* — Osha Bergman Watanabe & Burton LLP

(57) ABSTRACT

A support frame for a ventilation device for cooling a fluid passing through a cooling circuit of a motor vehicle is disclosed. The frame has an opening defining an opening perimeter configured to receive an impeller, and a central support positioned at the center of the opening and shaped to receive a motor actuating said impeller to generate a ventilation flow. The central support is attached, through said opening, to the frame by at least six holding arms, at
(Continued)

least three of which are placed in a first plane or cone of revolution, and another three of which are being placed in a second plane or cone of revolution, different from the first. The first holding arms are each separated from any second holding arm at the opening perimeter by a space covering at least a distance corresponding to a chord of said first holding arms.

8 Claims, 5 Drawing Sheets

(51) Int. Cl.

| | |
|---|---|
| ***F04D 19/00*** | (2006.01) |
| ***F04D 25/06*** | (2006.01) |
| ***F04D 29/52*** | (2006.01) |

(56) References Cited

U.S. PATENT DOCUMENTS

| | | | | |
|---|---|---|---|---|
| 4,805,868 A | | 2/1989 | Claude | |
| 5,342,167 A | * | 8/1994 | Rosseau | F04D 29/544 415/220 |
| 6,024,536 A | * | 2/2000 | Tsubakida | F04D 29/386 416/189 |
| 6,158,979 A | * | 12/2000 | Couetoux | F04D 29/582 417/423.15 |
| 6,206,635 B1 | * | 3/2001 | Golm | F04D 29/544 415/209.1 |
| 2005/0271529 A1 | * | 12/2005 | Stommel | F04D 29/663 417/423.15 |

FOREIGN PATENT DOCUMENTS

| | | |
|---|---|---|
| WO | 2013131641 A2 | 9/2013 |
| WO | 2014045179 A1 | 3/2014 |
| WO | 2016199195 A1 | 12/2016 |

* cited by examiner

SUPPORT FRAME HOLDING ARM

TECHNICAL FIELD

The present invention relates to the automotive field, and more particularly to the circulation of air for cooling an engine.

PRIOR ART

According to the prior art, motor vehicles evacuate the heat energy generated by their operation and are therefore equipped with heat exchangers, in particular cooling radiators, placed for example at the front of the vehicle, with for example external air passing through them. To force the circulation of this air through the exchanger(s), a fan is placed upstream or downstream. An impeller may be used to force air circulation. In some examples, the impeller generates a relatively high flow rate and a relatively low pressure and its flow is oriented axially, that is to say in the direction of an axis of rotation of the impeller.

SUMMARY

The present invention is defined by the attached independent claims. Further features and advantages stemming from the concepts disclosed herein are set forth in the description below. They can be obtained to some extent from the description or can be acquired by implementing the technologies described. The features and advantages of these concepts can be implemented and obtained by means of the instruments and combinations indicated in particular in the attached claims. These and other features of the technologies described will become more fully apparent from the following description and the attached claims, or may be inferred from putting into practice the concepts set forth herein.

This specification describes a support frame for a ventilation device for cooling a fluid passing through a cooling circuit of a motor vehicle, said frame comprising an opening defining an opening perimeter, the opening being intended to receive an impeller, and a central support positioned at the center of said opening and shaped so as to receive a motor actuating said impeller so as to generate a ventilation flow, said central support being attached, through said opening, to the frame by at least six holding arms, at least three first holding arms being placed in a first plane or cone of revolution (or cone herein), and at least three second holding arms being placed in a second plane or cone of revolution, different from the first plane or cone of revolution, the first holding arms each being separated from any second holding arm at the opening perimeter by a space covering at least a distance corresponding to a chord of said first holding arms.

A structure as described makes it possible to strengthen the frame by distributing the holding network formed by the holding arms, while allowing the flow to flow between the holding arms. This strengthening of the frame can make it possible to reduce the stresses related to the shape of said holding arms, or to avoid a phenomenon referred to as pumping, corresponding to a periodic, unwanted movement of the central support in the direction of the axis of rotation of the impeller caused by oscillation of the holding arms.

In some embodiments, the first holding arms are placed in a first plane and the second holding arms are placed in a second plane parallel to the first plane. This distribution of the holding arms in different planes makes it possible to rigidify the structure for holding the central support, any oscillation of the holding arms placed in the first plane being offset or prevented by the holding arms placed in the second plane. To be specific, such a structure improves the axial rigidity of the frame along the axis of rotation of the impeller.

In some embodiments, the first holding arms are placed in a first cone of revolution and the second holding arms are placed in a second cone of revolution, different from the first cone of revolution. Such a structure allows, by the use of different angles between the first and the second holding arms on the one hand, and the axis of rotation of the impeller on the other hand, mechanical offset that limits the aforementioned pumping effect, any movement of the first arms being at least partially offset by tension generated by the second arms, and vice versa. In some particular cases, the first holding arms form a first angle with a plane defined by the opening, the second holding arms forming a second angle with the plane defined by the opening, the first and the second angles being of the same sign. Such an arrangement can make it possible to limit the phenomenon of pumping while facilitating demolding without draft due to the use of angles going in the same direction. In some particular cases, the first holding arms form a first angle with a plane defined by the opening, the second holding arms forming a second angle with the plane defined by the opening, the first and the second angles being of opposite signs. This arrangement can allow interlacing between the first and the second holding arms allowing an improvement in torque transfer between the central support and the opening perimeter.

In some embodiments, each first holding arm is separated from another first holding arm by at least one second holding arm. Such a distribution makes it possible to improve the rigidity of the assembly, tension on the first holding arms being offset by a second holding arm placed between them.

In some embodiments, the first holding arms form groups of first holding arms following one another along the opening perimeter, each group of first holding arms being separated from another group of first holding arms at least by a second holding arm or by a group of second holding arms. Such a distribution allows partial interlacing between the first and second holding arms, such partial interlacing making it possible to simplify the structure while benefiting from a distribution between the first and the second holding arms along the opening perimeter.

In some embodiments, the first and second holding arms are regularly distributed along the opening perimeter. This facilitates balancing of the structure which will help reduce or prevent the phenomenon of pumping.

In some embodiments, the opening has the shape of a ring, the ring comprising three complementary sectors, each complementary sector covering 120 degrees of the ring, each complementary sector comprising the same number of first and second holding arms. Such a distribution makes it possible to obtain a particularly well-balanced structure facilitating regular rotation of the assembly.

In some embodiments, the holding arms have an aerodynamic shape. Such a shape allows the holding arms not only to play a role as a holder for the central support, but also to help generate the cooling flow by interacting with an aerodynamic shape of the impeller blades.

In some embodiments, the holding arms have a double-twisted aerodynamic shape. Such a shape has a particularly positive effect on the generation of the desired cooling flow. The mechanical flexibility introduced by the use of such a shape is offset by the rigidity of an arrangement of the holding arms such as in the present description.

In some embodiments, each holding arm is connected to the frame by a corresponding stud, said studs extending perpendicularly to the opening, some of said studs connected to the first holding arms having a first height perpendicular to the opening, starting from a plane comprising the opening, and some of the other of said studs connected to the second holding arms having a second height perpendicular to the opening, starting from the plane comprising the opening, the first height being different from the second height. Such an arrangement of studs allows the placement of the first and second arms at different heights, at a point where they are connected to the frame, in order to obtain a structure as described, while allowing the flow to pass between the studs.

This specification also describes a ventilation device comprising an impeller the motor of which is borne by the support frame according to the present description. Such a device can for example allow synergy between the shape of the impeller and the shape and position of the holding arms as described.

This specification also describes a cooling module for the heat engine of a motor vehicle comprising the ventilation device as described, the cooling module being able to implement aerodynamic synergy between its various components, in particular the holding arms as described.

BRIEF DESCRIPTION OF THE DRAWINGS

Further features, details and advantages will become apparent on reading the detailed description below, and on studying the attached drawings, in which.

DESCRIPTION OF THE EMBODIMENTS

Figure 1A:
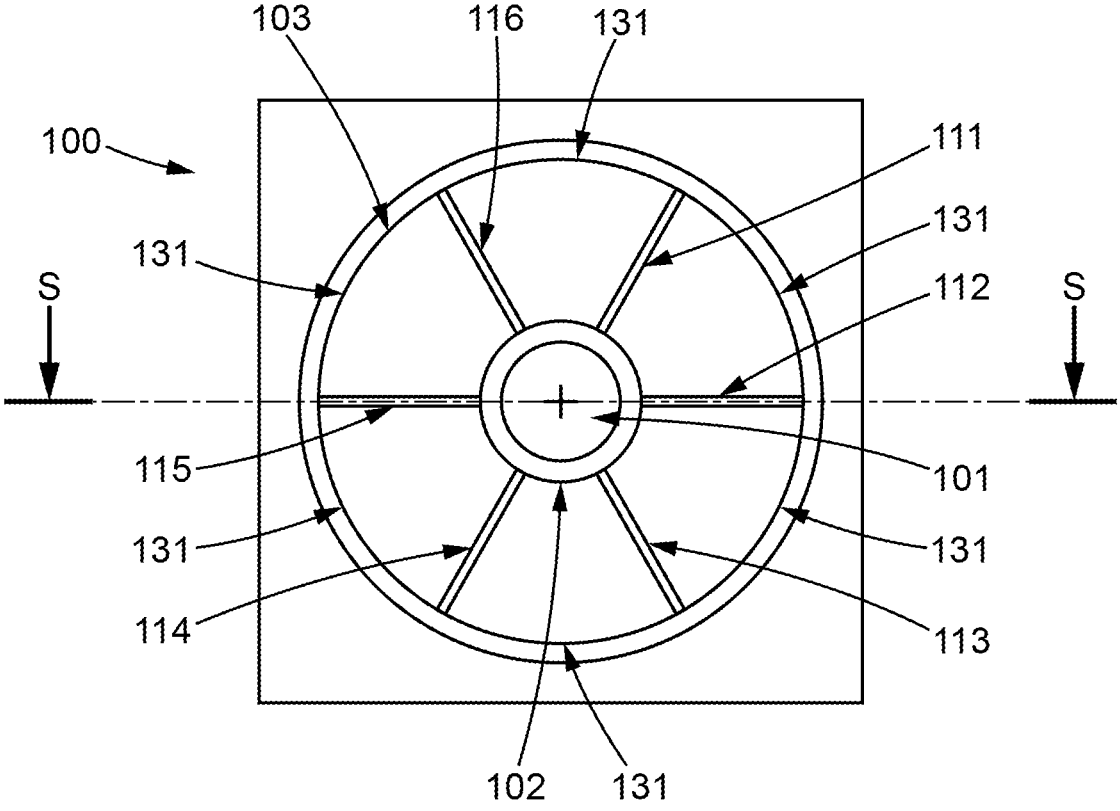
FIG. 1A shows an example of a support frame as disclosed herein.

This disclosure relates to a support frame for a ventilation device for cooling a fluid passing through a cooling circuit of a motor vehicle. This frame may in some cases be integrated into a motor fan unit. The motor vehicle may have thermal or electric propulsion, or hybrid propulsion. This frame may correspond to a base comprising a nozzle. This frame may have a generally parallelepiped shape, for example having external dimensions of between 1 and 8 cm thick in the axial direction of rotation of the impeller, and dimensions of between 20 and 60 cm per side in a plane normal to said axial direction. This frame may have a generally parallelepiped shape, for example having external dimensions of between 2 and 6 cm thick in the axial direction of rotation of the impeller, and dimensions of between 45 and 55 cm per side in a plane normal to said axial direction.

The frame disclosed herein comprises an opening defining an opening perimeter, the opening being intended to receive an impeller. Such an opening may have a generally circular opening perimeter having a diameter for example between 30 and 50 cm. Such an opening may have a generally circular opening perimeter having a diameter for example between 35 and 45 cm. Such an opening may have a generally circular opening perimeter having a diameter for example between 38 and 42 cm. This opening allows the circulation of a flow such as an air flow generated by the rotation of the impeller. In some examples, the shape of the opening corresponds to the shape of the impeller, the opening emerging in a plane normal to the axis of rotation of the impeller. In some cases, the opening has the general shape of a ring having an opening perimeter corresponding to the outer perimeter of the ring.

The opening perimeter determines the wall of a hollow cylindrical cavity in which the impeller is positioned, the cylindrical cavity having an axis corresponding to the axial direction or axis of rotation of the impeller. The frame can be used for attachment to a support, for example a cooling radiator or a vehicle chassis, and for supporting an electric motor that actuates the impeller and holding the shaft about which the impeller turns. Furthermore, aerodynamically, the frame may form a wall and limit or prevent recirculation between upstream and downstream of the impeller. The attachment for attaching an electric motor to the frame may be made up of several holding arms having a mechanical holding function. Such holding arms may be in the form of an airplane wing, or a stator vane, giving them an aerodynamic function in addition to their mechanical function. Stator vanes can straighten the flow, for example.

The frame disclosed herein comprises a central support positioned at the center of said opening. The center of the opening may correspond to the center of a circle corresponding to a perimeter of the opening. The center of the opening may include the location where the axis of rotation of the impeller intersects a plane comprising the opening. This central support is shaped to receive a motor actuating said impeller so as to generate a ventilation flow or stream. The frame disclosed herein not only makes it possible to define a nozzle through which the flow generated by the impeller flows but also to anchor a motor such as an electric motor actuating the impeller.

Said central support is attached, through said opening, to the frame by at least six holding arms. Such holding arms have a mechanical function for attaching the central support to the periphery of the frame through the opening. In order to ensure a degree of rigidity of the assembly, the number of holding arms must be sufficient. Each holding arm forms a bridge between the central support and the peripheral part of the frame defining the opening. Each holding arm has two ends, one end being connected to the central support, the other end being connected, possibly via a stud, to the opening perimeter. Between the two ends, the holding arms extend radially from the axis of rotation of the impeller. In some cases, said central support is attached, through said opening, to the frame by at least eight holding arms. In some cases, said central support is attached, through said opening, to the frame by at least ten holding arms. In some cases, said central support is attached, through said opening, to the frame by at least twelve holding arms. The use of a greater number of holding arms can contribute to better mechanical balancing of the assembly, and can offer increased freedom of use of particularly aerodynamic shapes for said holding arms.

Such holding arms have a mechanical role of holding a central support. Due to the fact that such holding arms pass through the opening and are therefore in the flow generated by the impeller, the holding arms have an influence on the aerodynamics of the assembly. It is therefore in some cases desirable to adapt, for example, the shape of the holding arms to the aerodynamics of the assembly. This can have consequences for the mechanical properties of the holding arms. A compromise must therefore be obtained in some cases in order on the one hand to obtain mechanical properties appropriate for the holding arms, and on the other hand to use a particularly aerodynamic shape for the holding arms. The support frame disclosed herein makes it possible to achieve this compromise by improving the rigidity of the structure by differentiated positioning of the holding arms as described. Such differentiated positioning makes it possible in particular to limit a phenomenon referred to as "pumping", which under certain conditions consists of an unwanted periodic movement of the central support in the direction of the axis of rotation of the impeller, due to excessive flexibility of the holding arms. The differentiated positioning of the holding arms as disclosed herein makes it possible to reduce the occurrence of such "pumping". Such differentiated positioning makes it possible to improve the rigidity of the assembly and therefore to provide increased freedom as to the choice of the shape of the holding arms, for example allowing the use of lightweight holding arms or holding arms having a particularly thin and aerodynamic shape.

As disclosed herein, at least three first holding arms are placed in a first plane or cone of revolution, and at least three second holding arms are placed in a second plane or cone of revolution, different from the first plane or cone of revolution. This differentiated placement of the holding arms improves the rigidity of the structure, limiting the aforementioned pumping phenomenon. It is possible that this improvement in rigidity is obtained owing to the fact that an inherent frequency of vibration of the first holding arms is different from an inherent frequency of vibration of the second holding arms, leading to synergistic stabilization of the assembly and therefore to a limitation or even suppression of the undesired pumping phenomenon. The introduction of such a difference in positioning offers increased freedom in the choice of the shape or even the materials used for the holding arms for a given rigidity of the structure. The use of the same first plane or cone of revolution for the first three holding arms makes it possible to obtain a certain homogeneity of placement of the first three holding arms contributing to the mechanical stability of the assembly, as well as to its ease of manufacture. Similarly, the use of the same second plane or cone of revolution for the second three holding arms makes it possible to obtain a certain homogeneity of placement of the second three holding arms contributing to the mechanical stability of the assembly, as well as to its ease of manufacture. In some cases, the first cone of revolution has as its axis the axis of rotation of the impeller corresponding to the center of the opening perimeter. In some cases, the second cone of revolution has as its axis the axis of rotation of the impeller corresponding to the center of the opening perimeter. In some cases, the first plane is parallel to a plane including the opening perimeter. In some cases, the second plane is parallel to a plane including the opening perimeter. In some cases, the number of first holding arms is equal to the number of second holding arms. In some cases, the number of first holding arms is greater than the number of second holding arms. In some cases, the number of first holding arms is less than twice the number of second holding arms. In some cases, the number of first holding arms is less than three times the number of second holding arms.

As disclosed herein, the first holding arms are each separated from any second holding arm at the opening perimeter by a space covering at least a distance corresponding to a chord of said first holding arms. Arranging such a space between the first holding arms and each second holding arm makes it possible, on the one hand, to obtain satisfactory mechanical behavior of each type of holding arm, preventing extreme proximity between a first and a second holding arm from leading to behavior similar to a single split holding arm, which would not make it possible to obtain the behavior of structural rigidity sought in this disclosure. A chord of said first holding arms corresponds for example to a thickness of a first holding arm in a direction tangential to the opening perimeter, corresponding to an angular direction of movement of the rotating impeller. This chord can be measured at different points along the holding arm, at different distances from the axis of rotation of the impeller. The distance corresponding to this chord may therefore vary for a given first holding arm. In some cases, the chord in question is the mean chord of the various chords of the first holding arm in question. In some cases, the chord in question is the median chord of the various chords of the first holding arm in question. In some cases, the chord in question is the maximum chord of the various chords of the first holding arm in question. In some cases, the chord in question is the minimum chord of the various chords of the first holding arm in question. In some cases, the chord in question is the chord of the first holding arm in question at the point of its attachment to the opening perimeter, opposite the central support. In some cases, the chord in question is the chord of the first holding arm in question at the point of its attachment to the central support. The distance corresponding to the chord in question is related to the opening perimeter in order to determine the distance that must separate the first holding arm from any second holding arm. It is understood that the same first holding arm will be closer to any second holding arm at the central support, owing to the structure of the assembly. This spacing, aside from mechanical consequences, allows the flow to flow between the holding arms in question. In some cases, the first holding arms are each separated from any second holding arm at the opening perimeter by a space covering at least twice a distance corresponding to a chord of said first holding arms. In some cases, the first holding arms are each separated from any second holding arm at the opening perimeter by a space covering at least three times a distance corresponding to three times a chord of said first holding arms. In some cases, the first holding arms are each separated from any second holding arm at the opening perimeter by a space covering at least four times a distance corresponding to three times a chord of said first holding arms.

FIG. 1A shows a frame as disclosed herein, showing a support frame 100 for a ventilation device for cooling a fluid passing through a cooling circuit of a motor vehicle, said frame 100 comprising an opening defining a circular opening perimeter 103, the opening being intended to receive an impeller (not shown), and a cylindrical central support 102 positioned at the center of said opening and shaped to receive a motor (not shown) actuating said impeller so as to generate a ventilation flow, said central support 102 being attached, through said opening, to the frame by six holding arms 111-116, at least three first holding arms 111, 113, 115 being placed in a first plane or cone of revolution, and at least three second holding arms 112, 114, 116 being placed in a second plane or cone of revolution, different from the first plane or cone of revolution, the first holding arms each being separated from any second holding arm at the opening perimeter by a space 131 covering at least a distance corresponding to a chord of said first holding arms.

In the configuration of FIG. 1A, the frame comprises first arms 111, 113 and 115 alternating with second arms 112, 114 and 116. In other words, each first holding arm is separated from another first holding arm by a second holding arm. Such a configuration is particularly well-balanced mechanically.

In some cases, each first holding arm is separated from another first holding arm by at least one second holding arm.

The frame may include additional holding arms that are neither first nor second holding arms, such additional holding arms having their own configuration and placement.

The frame shown in FIG. 1A may have a number of different configurations.

Figure 1B:
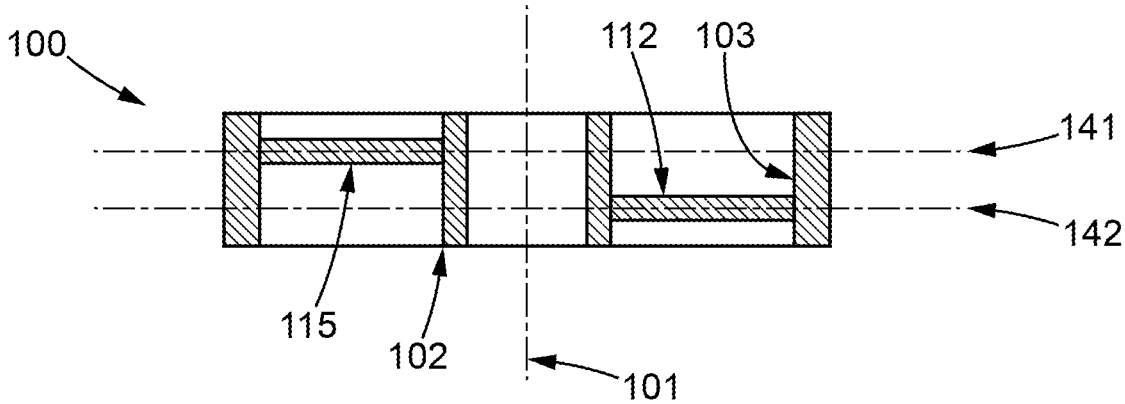
FIG. 1B shows an example of a cross section through a support frame as shown in FIG. 1A.

FIG. 1B shows a possible cross section through the frame according to the section S of FIG. 1A in a plane perpendicular to the view of FIG. 1A comprising the first holding arm 115 and the second holding arm 112. In this case, the first holding arms such as the first holding arm 115 are placed in a first plane 141. In this case, the second holding arms such as the second holding arm 112 are placed in a second plane 142. It is of course understood herein that the "placement" of a holding arm "in" a plane or a cone of revolution means the placement of a general axis of such a holding arm in such a plane or cone, and not the arm itself, a plane or a cone having in theory zero thickness. Such a general axis of the arm may correspond to a theoretical line segment joining the end of the corresponding arm in contact with the central support and the opposite end of the same arm in contact with the opening perimeter. In this example, the first plane and the second plane are planes normal to the axis 101 of rotation of the impeller or central axis of the frame or central axis of the central support. The distance separating the first and the second plane may in some cases be at least the thickness of a first holding arm measured at the junction between such first holding arm and the opening perimeter in the direction of rotation of the impeller. The distance separating the first and the second plane may in some cases be at least twice the thickness of a first holding arm measured at the junction between such first holding arm and the opening perimeter in the direction of rotation of the impeller. The distance separating the first and the second plane may in some cases be at least three times the thickness of a first holding arm measured at the junction between such first holding arm and the opening perimeter in the direction of rotation of the impeller. A greater difference between said planes can contribute to mechanical stability. Excessive distance may make the frame excessively bulky. The distance separating the first and the second plane may in some cases be at most four times the thickness of a first holding arm measured at the junction between such first holding arm and the opening perimeter in the direction of rotation of the impeller. The distance separating the first and the second plane may in some cases be at most three times the thickness of a first holding arm measured at the junction between such first holding arm and the opening perimeter in the direction of rotation of the impeller.

Figure 1C:
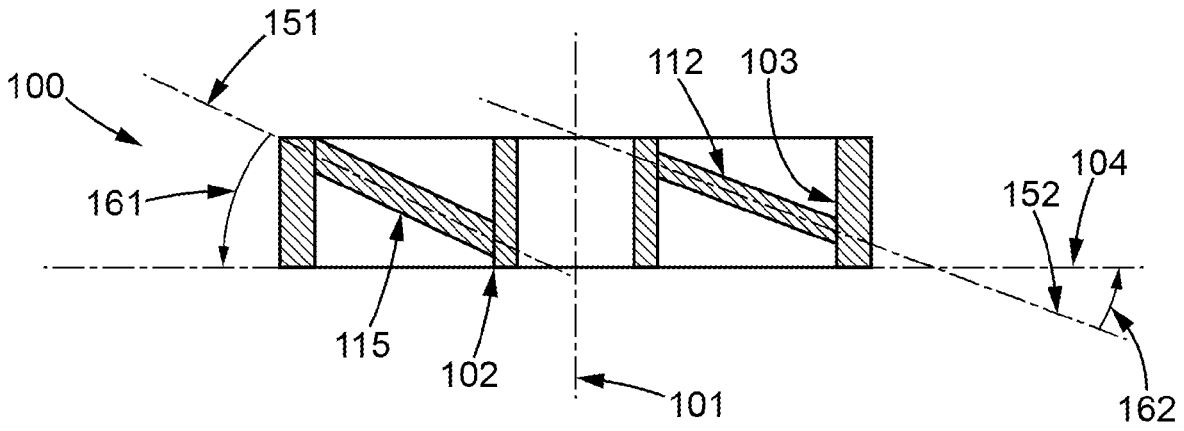
FIG. 1D shows an example of a cross section through a support frame as shown in FIG. 1A.
FIG. 1E shows an example of a cross section through a support frame as shown in FIG. 1A.
FIG. 1F shows an example of a support frame as disclosed herein.

FIG. 1C shows a possible cross section through the frame according to the section S of FIG. 1A in a plane perpendicular to the view of FIG. 1A comprising the first holding arm 115 and the second holding arm 112. In this case, the first holding arms such as the first holding arm 115 are placed in a first cone partially represented by the generatrix 151 of the first cone, the axis of the cone being the axis 101 of rotation of the impeller. In this case, the second holding arms such as the second holding arm 112 are placed in a second cone partially represented by the generatrix 152 of the second cone, the axis of the cone being the axis 101 of rotation of the impeller. The first cone of revolution is different from the second cone in order to obtain the effect sought in this disclosure. In this example, the first cone and the second cone are cones having the same axis 101 of rotation of the impeller or central axis of the frame or central axis of the central support. In this example, the first holding arms form a first angle 161 with a plane 104 defined by the opening, the second holding arms forming a second angle 162 with the plane 104 defined by the opening, the first and the second angles being of the same sign.

In some cases, the first angle and the second angle differ by at least 5 degrees. In some cases, the first angle and the second angle differ by at least 10 degrees. In some cases, the first angle and the second angle differ by at least 15 degrees. In some cases, the first angle and the second angle differ by at least 20 degrees. In some cases, the first angle and the second angle differ by at least 30 degrees. In some cases, the first angle and the second angle differ by at least 45 degrees. In some cases, the first angle and the second angle differ by less than 90 degrees. In some cases, the first angle and the second angle differ by less than 60 degrees. A greater difference between said first and second angles can contribute to mechanical stability. An excessive difference may make the frame excessively bulky. The first or second angle may be between −5 and +5 degrees. The first or second angle may be between −15 and +15 degrees. The first or second angle may be between −20 and +20 degrees. The first or second angle may be between −30 and +30 degrees.

Figure 1D:
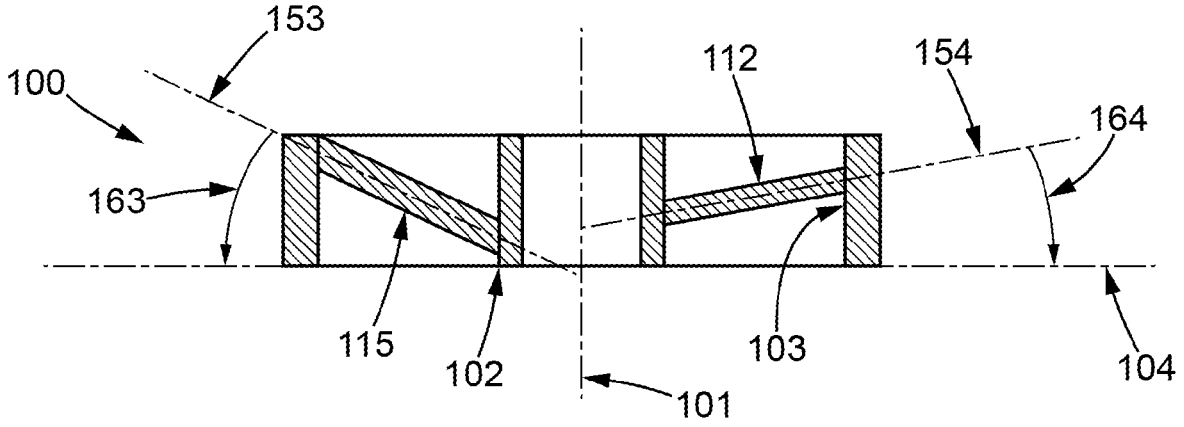

FIG. 1D shows a possible cross section through the frame according to the section S of FIG. 1A in a plane perpendicular to the view of FIG. 1A comprising the first holding arm 115 and the second holding arm 112. In this case, the first holding arms such as the first holding arm 115 are placed in a first cone partially represented by the generatrix 153 of the first cone, the axis of the cone being the axis 101 of rotation of the impeller. In this case, the second holding arms such as the second holding arm 112 are placed in a second cone partially represented by the generatrix 154 of the second cone, the axis of the cone being the axis 101 of rotation of the impeller. The first cone of revolution is different from the second cone in order to obtain the effect sought in this disclosure. In this example, the first cone and the second cone are cones having the same axis 101 of rotation of the impeller or central axis of the frame or central axis of the central support. In this example, the first holding arms form a first angle 163 with a plane 104 defined by the opening, the second holding arms forming a second angle 164 with the plane 104 defined by the opening, the first and the second angles being of opposite signs.

Figure 1E:
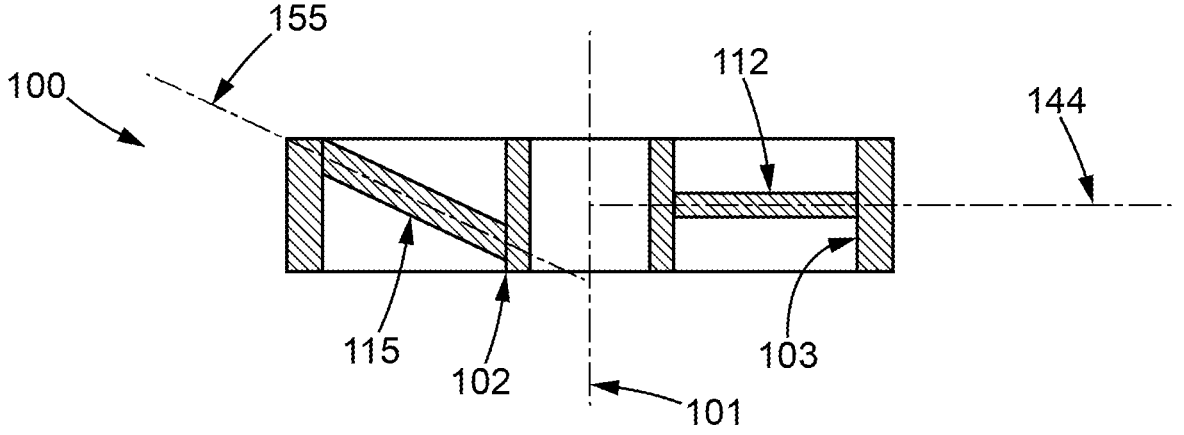

FIG. 1E shows a possible cross section through the frame according to the section S of FIG. 1A in a plane perpendicular to the view of FIG. 1A comprising the first holding arm 115 and the second holding arm 112. In this case, the first holding arms such as the first holding arm 115 are placed in a cone partially represented by the generatrix 155 of the first cone, the axis of the cone being the axis 101 of rotation of the impeller. In this case, the second holding arms such as the second holding arm 112 are placed in a plane 144 parallel to the plane comprising the opening.

Figure 1F:
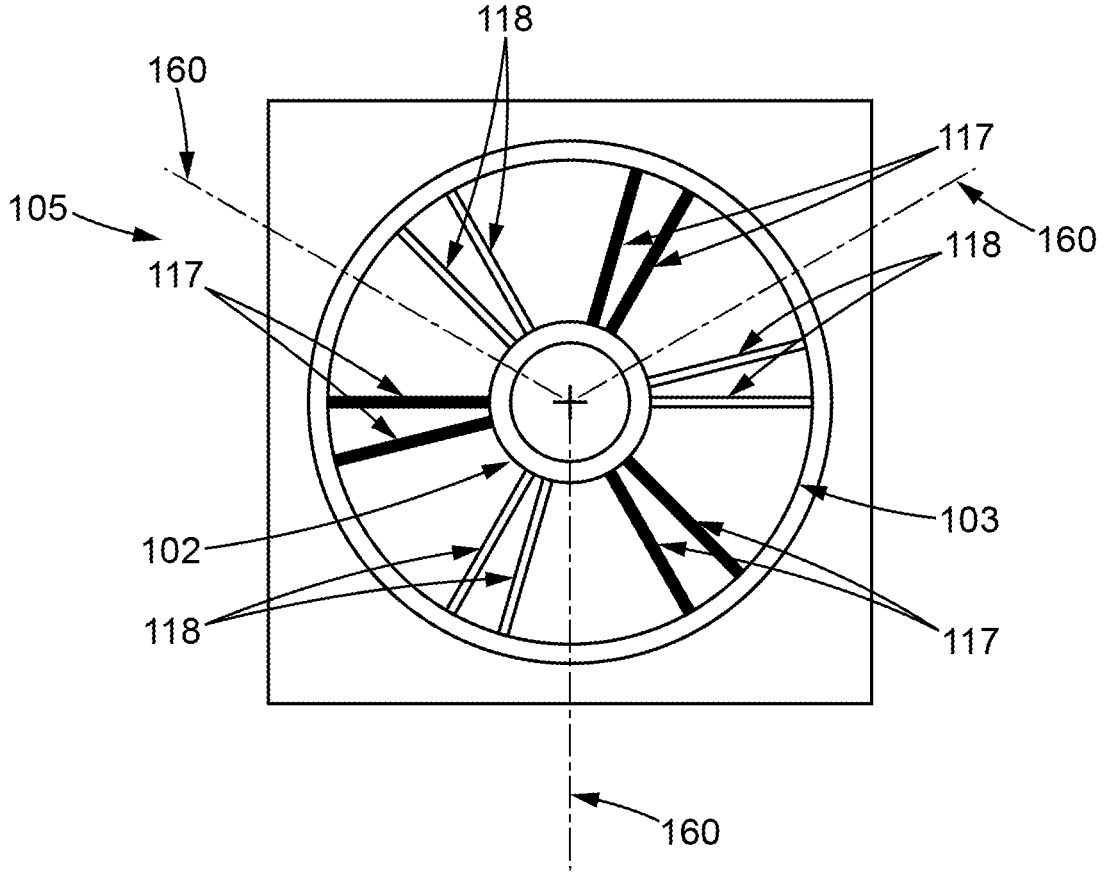

FIG. 1F shows an example of a frame 105 similar to the example shown in FIG. 1A, the frame 105 comprising six first holding arms 117 and six second holding arms 118, the first holding arms 117 forming groups of two first holding arms following one another along the opening perimeter, each group of first arms of two holding arms 117 being separated from another group of two first holding arms 117 at least by a group of second holding arms 118.

In some cases, such as in the case shown in FIG. 1F, the first holding arms form groups of first holding arms following one another along the opening perimeter, each group of first holding arms being separated from another group of first holding arms at least by a second holding arm or by a group of second holding arms. This makes it possible to increase the number of holding arms while maintaining a homogeneous structure.

Figure 2A:
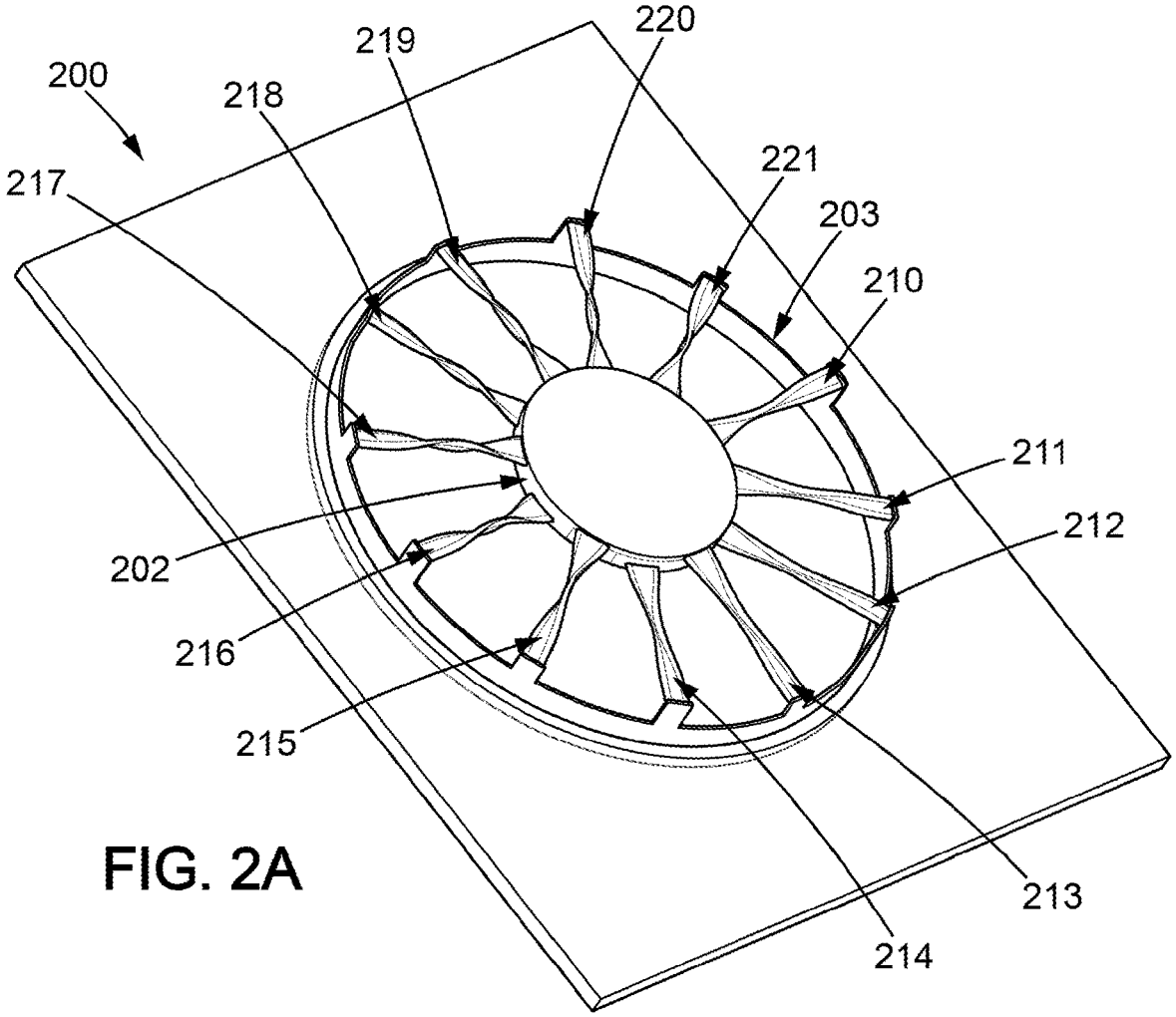
FIG. 2A shows an example of a support frame as disclosed herein.

In some cases, as shown for example in FIG. 1A, 1F or 2A, the opening has the shape of a ring, the ring comprising three complementary sectors, each complementary sector covering 120 degrees of the ring, each complementary sector comprising the same number of first and second holding arms. Taking as an example the frame 105 shown in FIG. 1F, the ring forming the opening is defined by the circumference of the central support 102 and by the opening perimeter 103. In this same FIG. 1F, three complementary sectors of 120 degrees of this ring are limited by the axes 160. Each of these three sectors shown comprises four holding arms, the same number of first holding arms and second holding arms, specifically in this case two holding arms 117 and two holding arms 118 per sector. This provides a balanced structure, preventing or reducing vibration during rotational movement of the impeller. In some cases, the ring comprises six complementary sectors, each complementary sector covering 60 degrees of the ring, each complementary sector comprising the same number of first and second holding arms.

In some cases, as shown for example by the frame 200 in FIG. 2A, the holding arms have an aerodynamic shape, such as the twelve holding arms 210-221 between the opening perimeter 203 and the central support 202 of the frame 200. This can improve the flow obtained by the use of the frame by adding to the holding arms an aerodynamic role beyond their role as mechanical supports. The holding arms 210-221 include six first holding arms 211, 213, 215, 217, 219, and 221 and six second holding arms 210, 212, 214, 216, 218, and 220. In this case, the first and second holding arms are alternating. In this case, as illustrated in more detail in FIG. 2B, the first holding arms are attached to a first level N1 of the central support, the second holding arms being attached to a second level N2 of the central support, the level N1 being different from the level N2 along an axis 201 of rotation of the impeller, said axis 201 being normal to a plane comprising the opening. In this case, as further illustrated in FIG. 2B, the first holding arms are attached to a third level N3 of the central support, the second holding arms being attached to a fourth level N4 of the central support, the level N3 being different from the level N4 along the axis 201 of rotation of the impeller. These staggered levels result in an embodiment as disclosed herein which avoids placing all the holding arms in the same plane or cone of revolution in order to obtain a particularly rigid structure, which is particularly effective in the event of use of holding arms of aerodynamic shape which tend to be more flexible.

In some cases, each holding arm is connected to the frame by a corresponding stud, said studs extending perpendicularly to the opening, some of said studs connected to the first holding arms having a first height perpendicular to the opening, starting from a plane comprising the opening, and some of the other of said studs connected to the second holding arms having a second height perpendicular to the opening, starting from the plane comprising the opening, the first height being different from the second height. The use of such studs can make it possible to facilitate the generation of a flow in the radial direction passing between consecutive studs.

Figure 2B:
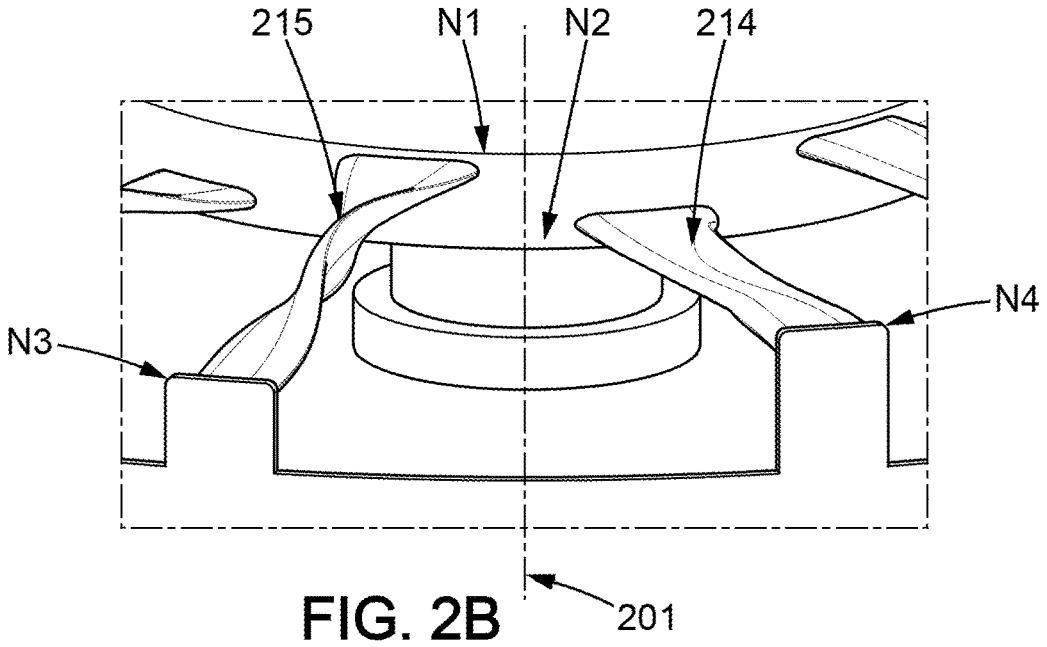
FIG. 2B shows a part of the frame shown in FIG. 2A.

In the case of the frame shown in FIGS. 2A and 2B, each holding arm 210-221 is connected to the frame 200 by a corresponding stud, said studs extending perpendicularly to the opening, some of said studs connected to the first holding arms having a first height, corresponding to the level N3, perpendicular to the opening, starting from a plane comprising the opening, and some of the other of said studs connected to the second holding arms having a second height, corresponding to the level N4, perpendicular to the opening, starting from the plane comprising the opening, the first height being different from the second height.

An aerodynamic shape may include a leading edge and a trailing edge, a flow being incident with the leading edge, the flow following a pressure side and a suction side. The pressure side and the suction side meet at the trailing edge beyond which the flow flows. An aerodynamic shape comprises a chord line and a camber line, the chord line following a straight line joining the leading edge and the trailing edge, the camber line being a curve joining the leading edge and the trailing edge, the camber line being a curve halfway between the pressure side and the suction side. A leading edge continues to a point of maximum thickness.

In some cases, the holding arms have a particularly aerodynamic double-twisted shape.

The holding arms 210-221 have for example a double-twisted shape which aims to reduce drag due to the friction of the air against said holding arms during the operation of an impeller. Such arms may have, in addition to their mechanical function, a dual aerodynamic and acoustic function. Instead of arms in the form of flat plates oriented according to the direction of the flow passing through the impeller, aerodynamically shaped holding arms in some cases consist of thin blades, of large span and elongate section, with a chord having a length at least 1.5 times greater than that of their thickness, in particular at their point of greatest thickness. These holding arms have an aerodynamic profile to reduce their drag, and a pitch angle of the profile evolves all along their span, between their root borne by the central support 202 and their tip connected to the opening perimeter 203. The pitch angle of the section profile of said holding arm may for example evolve along their span, from a substantially radial orientation at its foot and the central support 202, becoming a much more axial orientation mid-span along the holding arm, before returning to a substantially radial orientation at its tip and the opening perimeter 203. The pitch angle law, i.e. the angle that the chord of this section makes with the axial direction of rotation of the impeller, normal to the plane defined by the opening, evolves along the span so as to adapt to the direction and to the gyration of the flow at the outlet of the impeller. This is beneficial both as regards aerodynamic efficiency and as regards a reduction in instability which generates noise. In some cases the root pitch angle, just like the tip pitch angle, has a high value (for example greater than 70°), whereas the central part of the blade, i.e. that between 25 and 75% of the span, has a relatively low pitch angle (for example less than 20°). The holding arms 210-221 have for example a double-twisted shape all along a line connecting the mid-chord points of the holding arm, the twisting being formed by a rotation of the section of the stator, in a tangential plane, when describing this line from the root to the tip of the holding arm. It is said to be double-twisted because the twist increases from the root towards mid-span, then decreases from mid-span towards the tip, becoming once again slightly twisted. According to an embodiment not shown, the evolution of the pitch angle could be interrupted, or follow another law, in the central part of the stator. Such a double-twisted shape reduces the rigidity of the arms, which therefore particularly benefit from the different configurations as disclosed herein.

In some cases, the first holding arms join the central support at a first level of an impeller axis of rotation and the second holding arms join the central support at a second level of an impeller axis of rotation, the first level and the second level being separated by at least 50% of the maximum thickness of a first holding arm, the thickness being measured along the span of the holding arm (or stator), without taking its ends into account.

In some cases, the first holding arms join the opening perimeter at a first level of an impeller axis of rotation and the second holding arms join the central support at a second level of an impeller axis of rotation, the first level and the second level being separated by at least 50% of the maximum thickness of a first holding arm, the thickness being measured along the span of the holding arm (or stator), without taking its ends into account.

In some cases, the first holding arms join the central support at a first level of an impeller axis of rotation and the second holding arms join the central support at a second level of an impeller axis of rotation, the first level and the second level being separated by at most three times the maximum length of a chord of a first holding arm, the chord being between a leading edge and a corresponding trailing edge of said holding arm.

In some cases, the first holding arms join the opening perimeter at a first level of an impeller axis of rotation and the second holding arms join the central support at a second level of an impeller axis of rotation, the first level and the second level being separated by at most three times the maximum length of a chord of a first holding arm, the chord being between a leading edge and a corresponding trailing edge of said holding arm.

In some cases, the first holding arms cross the second holding arms. Such a configuration is particularly rigid while ensuring compactness.

Figure 3:
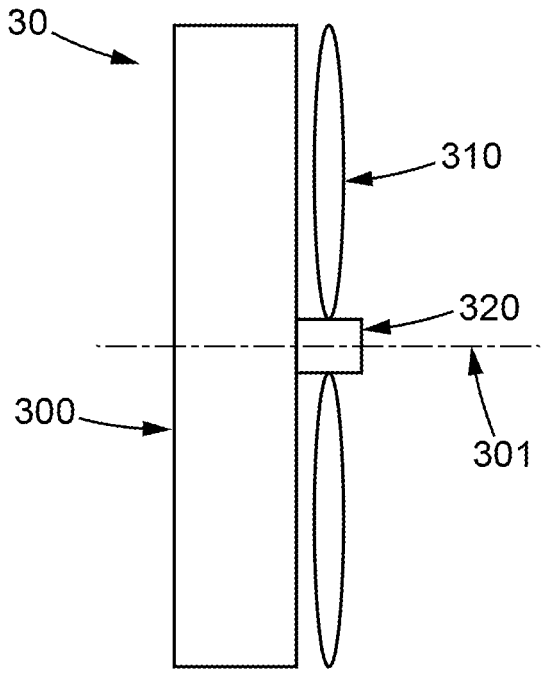
FIG. 3 shows an example of a ventilation device as disclosed herein.

FIG. 3 shows a simplified view of an example of a ventilation device 30 comprising an impeller 310 the motor 320 of which is borne by a support frame 300 as disclosed herein. The impeller 310 has an axis of rotation 301 which may for example correspond to the axis 101 or 201 of the previous figures. The impeller may be placed either between the frame and the motor to be cooled. The frame may also be located between the impeller and the motor to be cooled. The combination of the aerodynamic function of the impeller with the aerodynamic shape of the studs as disclosed herein makes it possible to obtain an improvement in the performance of the system as a whole. This performance is further improved by combining the aerodynamic capacities of the impeller, the studs as disclosed herein and a holding arm aerodynamic shape.

Figure 4:
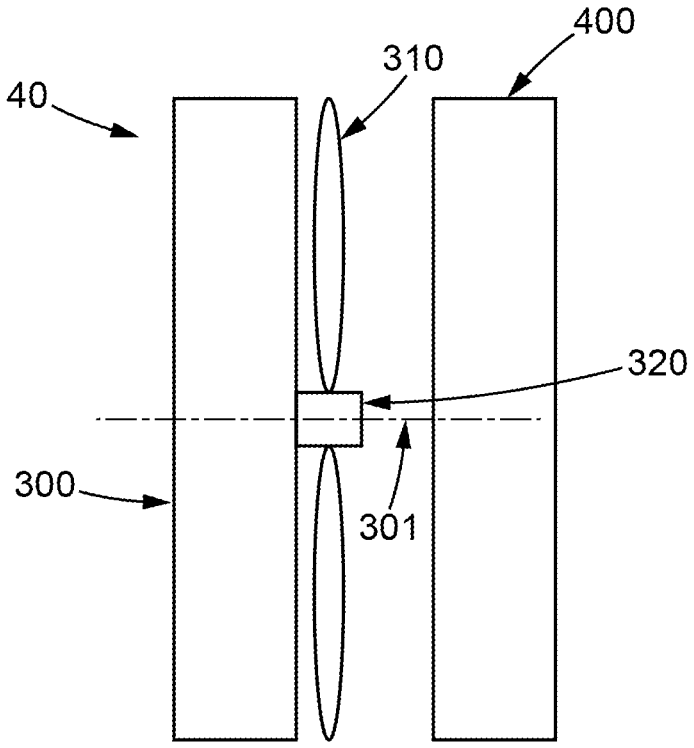
FIG. 4 shows an example of a ventilation device as disclosed herein.

FIG. 4 shows an example of a cooling module 40 for the heat engine of a motor vehicle comprising a ventilation device as disclosed herein. In this case, the module includes the elements shown in FIG. 3, as well as a radiator 400 subjected to the flow that is generated by the impeller 310 and modified by the aerodynamic shape of the studs as disclosed herein. In this case, the impeller is placed between the radiator 400 and the frame 300, but the frame 300 could also be placed between the impeller and the radiator.

The invention claimed is:

1. A support frame for a ventilation device for cooling a fluid passing through a cooling circuit of a motor vehicle, said frame comprising:

an opening defining an opening perimeter, the opening being configured to receive an impeller; and a central support positioned at the center of said opening and shaped so as to receive a motor actuating said impeller so as to generate a ventilation flow, said central support being attached, through said opening, to the frame by at least six holding arms, at least three first holding arms of the at least six being placed in a first cone of revolution, and at least three second holding arms of the at least six being placed in a second cone of revolution, different from the first cone of revolution, the first holding arms each being separated from any second holding arm at the opening perimeter by a space covering at least a distance corresponding to a chord of said first holding arms, wherein the first holding arms are placed in the first cone of revolution and the second holding arms are placed in the second cone of revolution, different from the first cone of revolution.

2. The frame as claimed in claim 1, the first holding arms forming a first angle with a plane defined by the opening, the second holding arms forming a second angle with the plane defined by the opening, the first and the second angles being of opposite signs.

3. The frame as claimed in claim 1, the first holding arms forming a first angle with a plane defined by the opening, the second holding arms forming a second angle with the plane defined by the opening, the first and the second angles being of the same sign.

4. The frame as claimed in claim 1, the first holding arms forming groups of first holding arms following one another along the opening perimeter, each group of first holding arms being separated from another group of first holding arms at least by a second holding arm or by a group of second holding arms.

5. The frame as claimed in claim 1, the opening having the shape of a ring, the ring comprising three complementary sectors, each complementary sector covering 120 degrees of the ring, each complementary sector comprising the same number of first and second holding arms.

6. The frame as claimed in claim 1, each holding arm being connected to the frame by a corresponding stud, said studs extending perpendicularly to the opening, some of said studs are connected to the first holding arms having a first height perpendicular to the opening, starting from a plane comprising the opening, and some of the other of said studs are connected to the second holding arms having a second height perpendicular to the opening, starting from the plane comprising the opening, the first height being different from the second height.

7. A ventilation device comprising an impeller, and a motor of which is borne by the support frame as claimed in claim 1.

8. A cooling module for a heat engine of a motor vehicle comprising the ventilation device as claimed in claim 7.

* * * * *